US008426756B2

(12) United States Patent
Yang et al.

(10) Patent No.: US 8,426,756 B2
(45) Date of Patent: Apr. 23, 2013

(54) KEY ASSEMBLY FOR PORTABLE ELECTRONIC DEVICE USING THE SAME

(75) Inventors: Mu-Wen Yang, Taipei Hsien (TW); Chih-Chiang Chang, Taipei Hsien (TW)

(73) Assignee: FIH (Hong Kong) Limited, Kowloon (HK)

( * ) Notice: Subject to any disclaimer, the term of this patent is extended or adjusted under 35 U.S.C. 154(b) by 975 days.

(21) Appl. No.: 12/488,721

(22) Filed: Jun. 22, 2009

(65) Prior Publication Data

US 2010/0039299 A1 Feb. 18, 2010

(30) Foreign Application Priority Data

Aug. 15, 2008 (CN) ..... 2008 1 0303855

(51) Int. Cl.
*H01H 13/02* (2006.01)

(52) U.S. Cl.
USPC ..... 200/343; 200/296; 200/341

(58) Field of Classification Search ..... 200/5 R, 200/296, 341–345, 518, 520, 552, 553, 557, 200/558, 561, 573, 574, 332, 335, 339; 345/156, 345/157, 168, 169, 184; 341/22, 35; 455/575.1; 361/752, 837, 679.56, 679.08, 679.09, 679.3
See application file for complete search history.

(56) References Cited

U.S. PATENT DOCUMENTS

| | | | | |
|---|---|---|---|---|
| 4,054,766 | A * | 10/1977 | Kramer | 200/522 |
| 6,239,726 | B1 * | 5/2001 | Saida | 340/999 |
| 6,580,044 | B2 * | 6/2003 | Ogawa et al. | 200/552 |
| 7,348,511 | B2 * | 3/2008 | Chen et al. | 200/296 |
| 7,800,008 | B2 * | 9/2010 | Shi et al. | 200/547 |
| 2001/0003325 | A1 * | 6/2001 | Nakagawa et al. | 200/343 |
| 2007/0246340 | A1 * | 10/2007 | Zhao et al. | 200/339 |
| 2007/0289857 | A1 * | 12/2007 | Kim | 200/341 |
| 2008/0088489 | A1 * | 4/2008 | Moon | 341/22 |

* cited by examiner

*Primary Examiner* — Michael Friedhofer
(74) *Attorney, Agent, or Firm* — Altis Law Group, Inc.

(57) ABSTRACT

A key assembly comprises a connecting element, a first key and a second key. The first key includes a first body member and a first elastic member protruding from one end of the first body member, another end of the first body member connects with the connecting element. The second key includes a second body member and a second elastic member protruding from one end of the second body member, and another end of the second body member connects with the connecting element. The first elastic member provides a returning force for the first body member, and the second elastic member provides a returning force for the second body member.

18 Claims, 6 Drawing Sheets

KEY ASSEMBLY FOR PORTABLE ELECTRONIC DEVICE USING THE SAME

This application is related to U.S. patent application Ser. No. 12/488,722, entitled "KEY ASSEMBLY AND PORTABLE ELECTRONIC DEVICE USING THE SAME", by Mu-Wen Yang et al. Such application has the same assignee as the present application and has been concurrently filed herewith. The above-identified application is incorporated herein by reference.

BACKGROUND

1. Technical Field

The present disclosure generally relates to key assemblies, and particularly to key assemblies used in portable electronic devices.

2. Description of Related Art

With the development of smaller and lighter electronic devices for portable use, key assemblies have become more compact with keys more tightly spaced. Unfortunately, users of these portable electronic sometimes experience difficulty in pressing keys that are placed so close together; users may easily press more than one key at a time or press a wrong key. This drawback exists for users of cellular telephones and other portable electronic devices with key assemblies.

Thus, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the exemplary key assembly and portable electronic device using the key assembly. Moreover, in the drawings like reference numerals designate corresponding parts throughout the several views. Wherever possible, the same reference numbers are used throughout the drawings to refer to the same or like elements of an exemplary embodiment.

DETAILED DESCRIPTION

Figure 1:
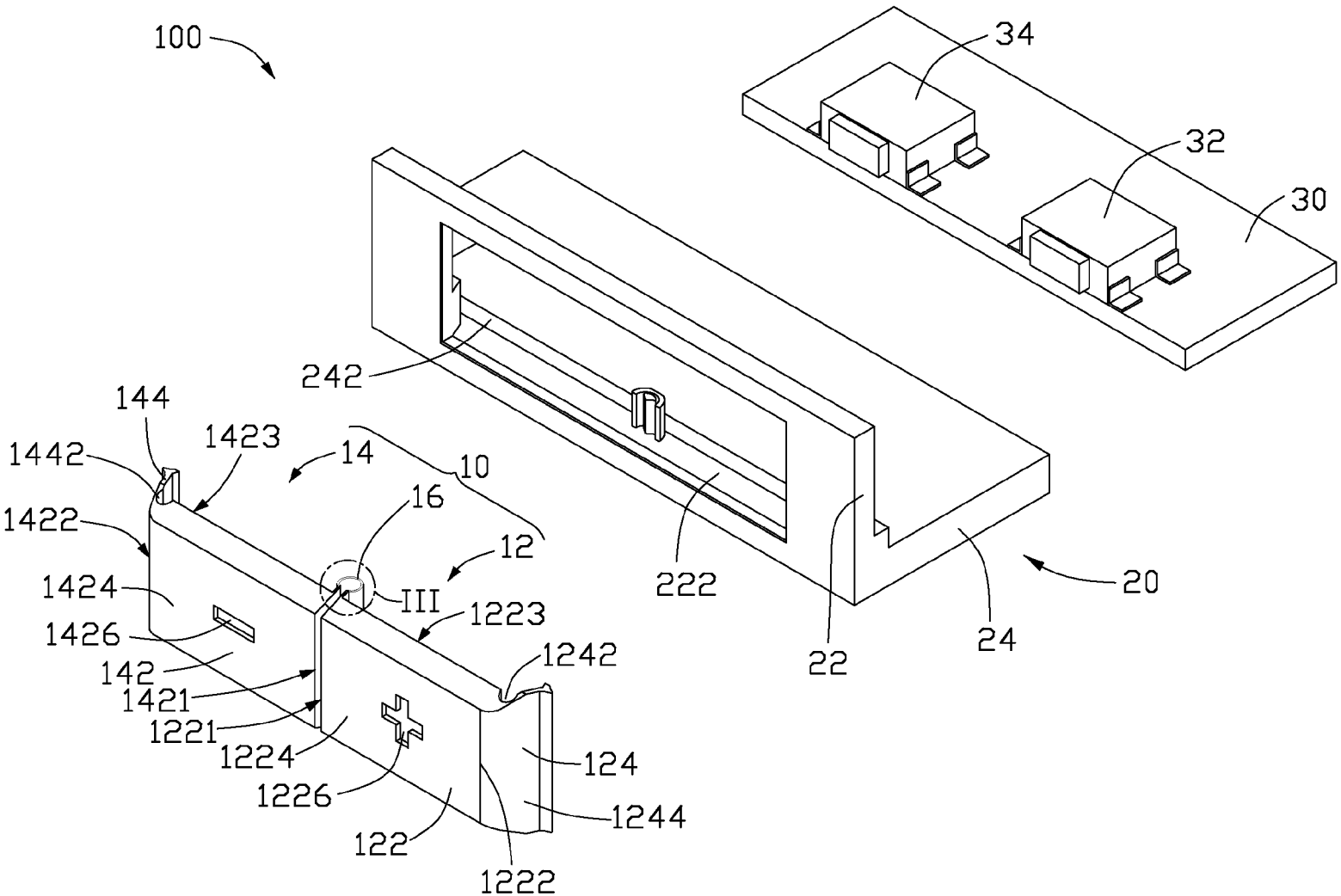
FIG. 1 is an exploded, isometric view of an exemplary embodiment of a key assembly used in a portable electronic device, the portable electronic device including the key assembly, a housing, and a circuit board.
Figure 2:
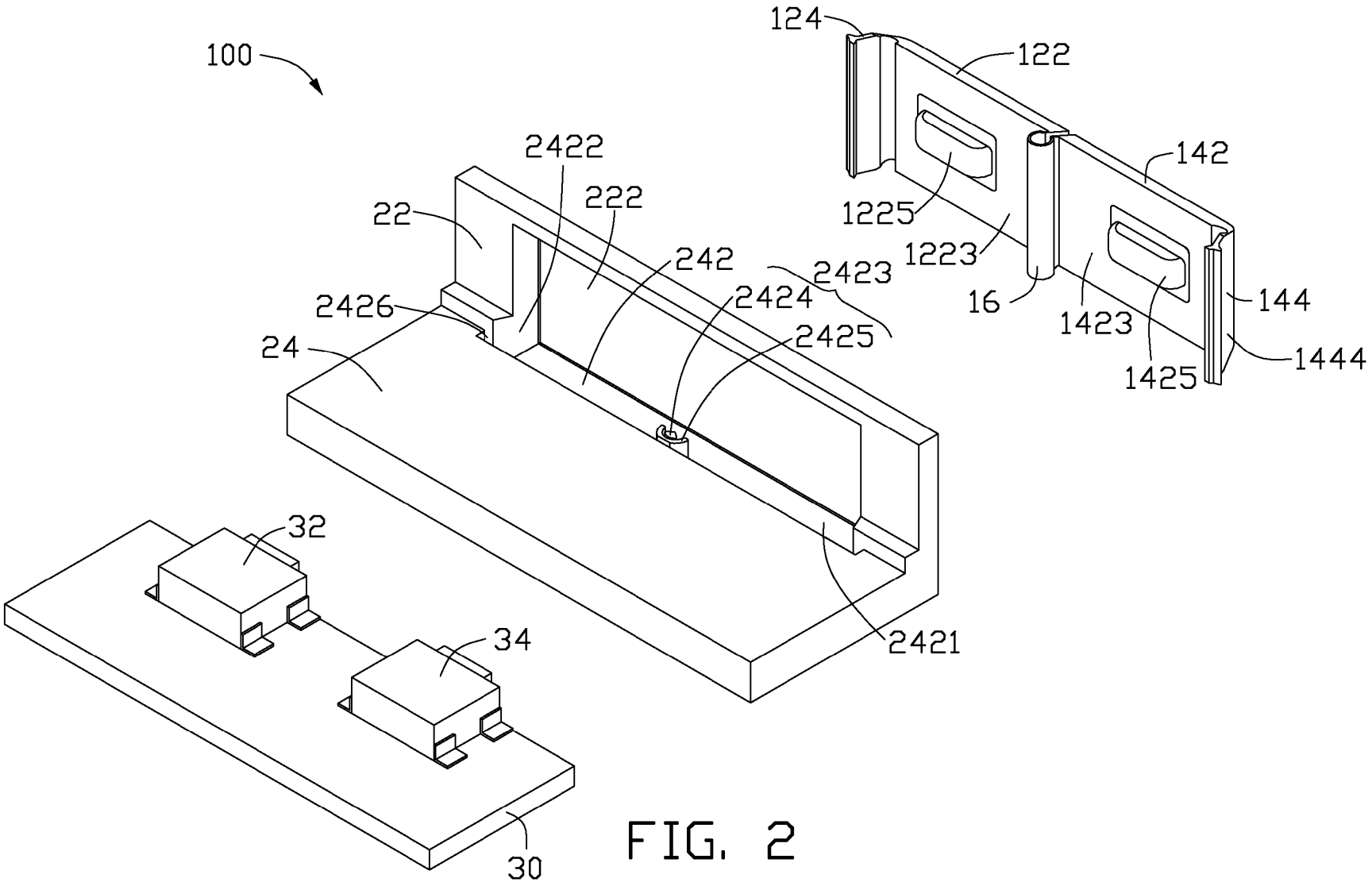
FIG. 2 is similar to FIG. 1, but shows the portable electronic device in another aspect.

Referring to FIGS. 1 to 2, an exemplary embodiment of a key assembly 10 can be used on a portable electronic device 100, such as a cellular phone or any electronic device where a side key is desirable. The portable electronic device 100 includes a key assembly 10, a housing 20 (portion of the housing shown) and a circuit board 30. The key assembly 10 and circuit board 30 are both mounted to the housing 20. The circuit board 30 has a first switch 32 and a second switch 34 spaced from the first switch 32. The first switch 32 and the second switch 34 are both mounted to the circuit board 30.

The key assembly 10 is configured to depress the first switch 32 and the second switch 34, to control the circuit board 30.

The key assembly 10 includes a first key 12 corresponding to the first switch 32, a second key 14 corresponding to the second switch 34 and a connecting element 16. The connecting element 16 is located between the first key 12 and the second key 14, to connect the first key 12 with the second key 14.

The first key 12 is substantially "L"-shaped and includes a first body member 122 and a first elastic member 124 extending from one end of the first body member 122. The first body member 122 can have any shape. The first body member 122 has a first end 1221 located adjacent to the second key 14, a second end 1222 located opposite to the first end 1221, a first contact surface 1223 facing the circuit board 30 and a first operating surface 1224 located opposite to the first contact surface 1223.

Figure 6:
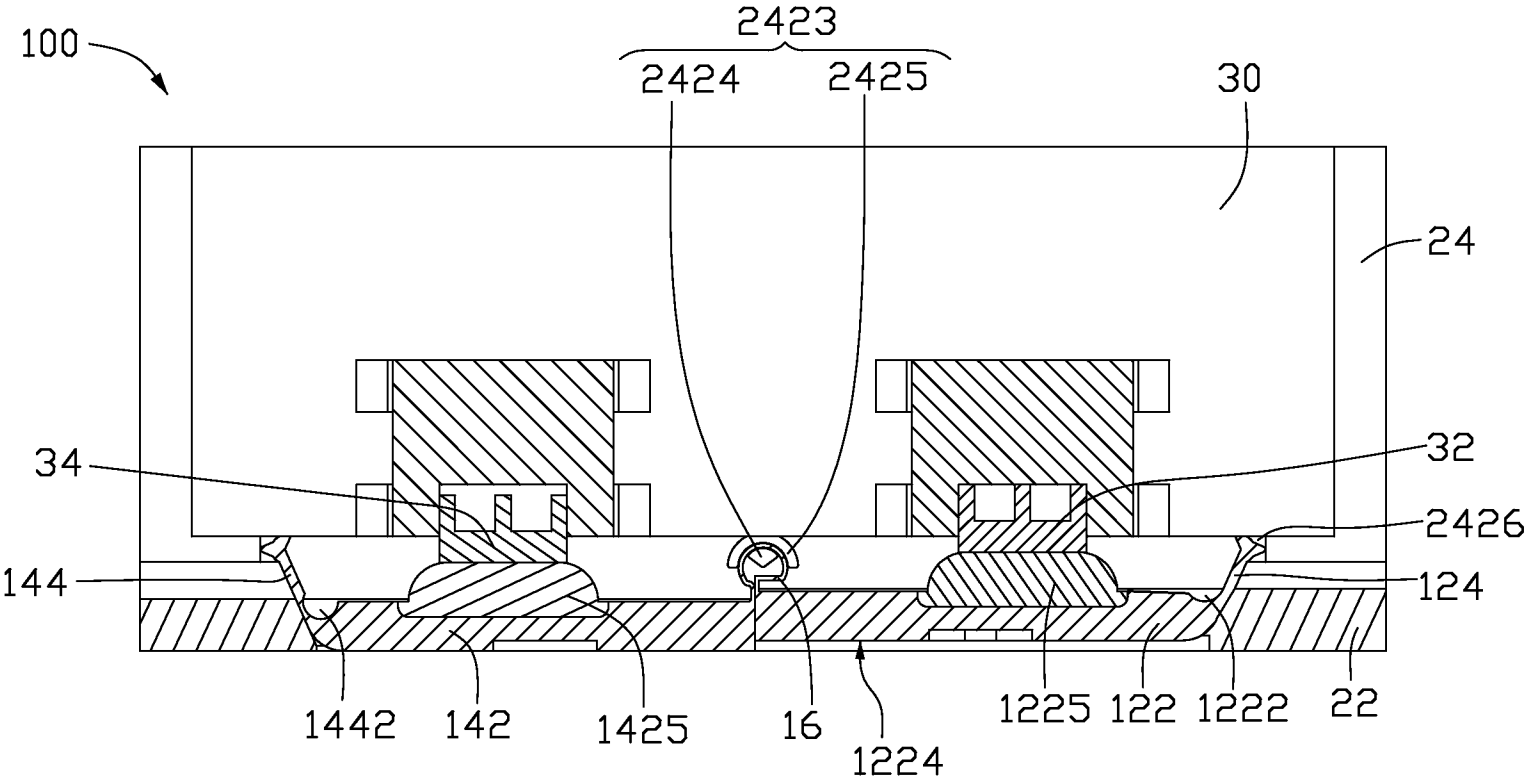
FIG. 6 is similar to FIG. 5, but shows one key of the key assembly activated.

The first end 1221 is bonded to the connecting element 16 to connect the first key 12 with the connecting element 16. The first elastic member 124 protrudes from the second end 1222 substantially perpendicular to the first body member 122. The first elastic member 124 has a distal end located in front of first contact surface 1223 and configured for resisting the housing 20 (as shown in FIG. 6). The first key 12 has a first slot 1242 defined in a joint thereof between the first body member 122 and the first elastic member 124, on an inner side of the first key 12. The first slot 1242 reduces the thickness of the first elastic member 124, which can then be easily deformed when the first key 12 is pressed. The first elastic member 124 has a first wedged plane 1244 defined at an outer side thereof. The first wedged plane 1244 is configured to resist the housing 20 to prevent the first key 12 from detaching from the housing 20.

The first contact surface 1223 has a first contact portion 1225 protruding from the center thereof. The first contact portion 1225 may be injection-molded thermoplastic elastomer configured to feed a point-contact sensation back to the user to provide tactile feedback when the first key 12 is depressed. The first operating surface 1224 has a first indicia 1226 defined thereon, to indicate the function of the first key 12, such as, for example, "+", indicating that the function of the first key 12 is to increase volume.

The second key 14 has the same shape and size as the first key 12 in this embodiment. The second key 14 is substantially "L"-shaped and includes a second body member 142 and a second elastic member 144 extending from one end of the second body member 142. The second key 14 has a third end 1421 located adjacent to the first key 12, a fourth end 1422 located opposite to the third end 1421, a second contact surface 1423 facing the circuit board 30 and a second operating surface 1424 located opposite to the second contact surface 1423.

The third end 1421 is bonded to the connecting element 16 to connect the second key 14 with the connecting element 16. The second elastic member 144 protrudes from the fourth end 1422 substantially perpendicular to the second body member 142. The second elastic member 144 has a distal end located in front of second contact surface 1423 and configured for resisting the housing 30 (seen FIG. 6). The second key 14 has a second slot 1442 defined in a joint between the second body member 142 and the second elastic member 144, and the second slot 1442 is located in an inner side of the first key 12. Second slot 1442 reduces thickness of the second elastic member 144, is thus easily deformed when the second key 14 is depressed. The second elastic member 144 has a second wedged plane 1444 defined on an outer side thereof. The second wedged plane 1444 is configured to resist the housing 30 to prevent the second key 14 from detaching from the housing 30.

The second contact surface 1423 has a second contact portion 1425 protruding from the center thereof. The second contact portion 1425 may be injection-molded thermoplastic elastomer configured to feed back point-contact sensation to the user for tactile feedback when second key 14 is depressed. The second operating surface 1424 has a second indicia 1426 defined thereon, to indicate the function of the second key 14, which may be, for example, "–", indicating function of the second key 14 to be decreasing volume.

Figure 3:
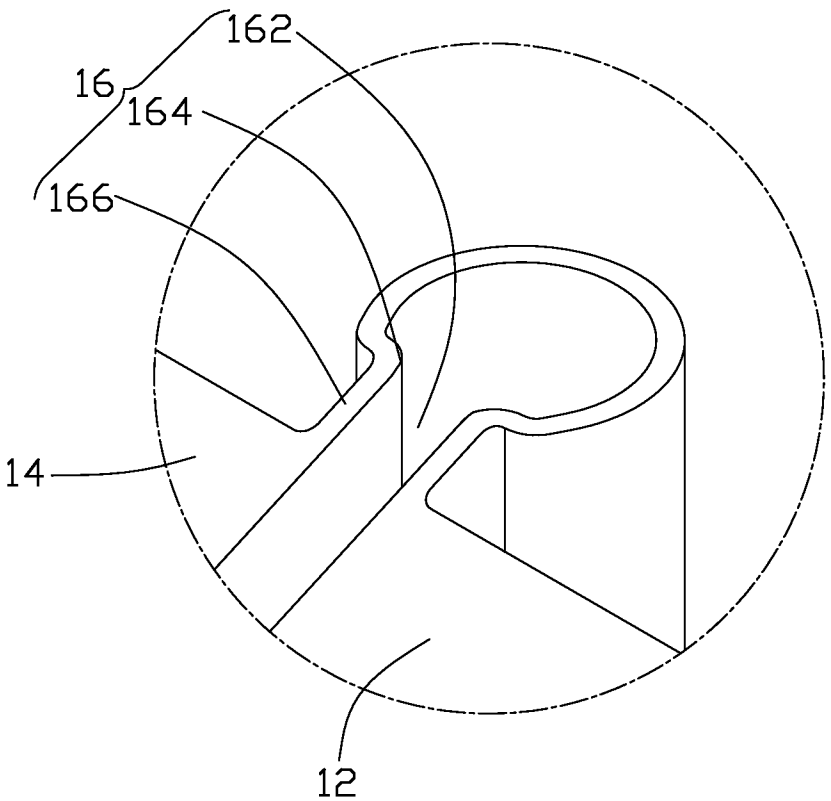
FIG. 3 is an enlarged view of area III shown in FIG. 1.

Referring to FIGS. 1 and 3, the connecting element 16 is substantially a hollow cylinder. The connecting element 16 may be injection-molded from thermoplastic elastomer, so the connecting element 16 is deformed when an external force is exerted thereon, and then rebounds when the external force is removed. The connecting element has a slit 162 longitudinally defined therein, in which two opposite sidewalls 164 of the connecting element 16 are defined. Each sidewall 164 has a connecting portion 166 protruding therefrom and radially facing away from the center of the connecting element 16. One connecting portion 166 is configured to connect with the first key 12, and another connecting portion 166 is configured to connect with the second key 14, with the result being that the first key 12 and the second key 14 become integrated.

Figure 5:
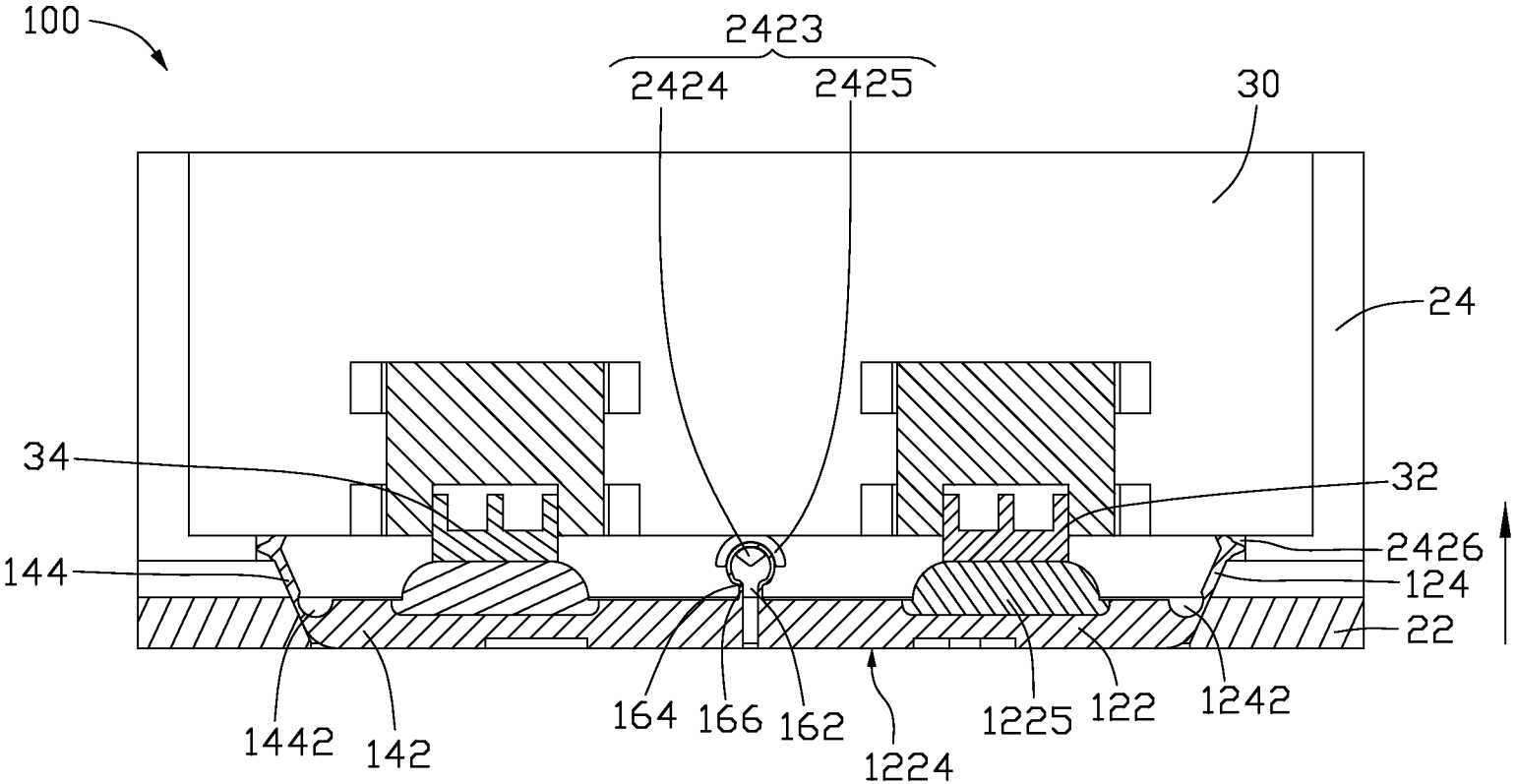
FIG. 5 is a cutaway view of the portable electronic device shown in FIG. 4.

Referring to FIGS. 2 and 5, the housing 30 includes a peripheral wall 22 and a bottom wall 24 connected with the peripheral wall 22. The peripheral wall 22 has a hole 222 defined therein. The hole 222 is sized and configured to engage the key assembly 10. The bottom wall 24 has a groove 242 defined therein adjacent to the peripheral wall 22. The groove 242 communicates with the hole 222, so a footwall 2422 and two opposite inside walls 2424 are defined in the groove 242. The footwall 2422 has a secured portion 2423 protruding upwardly therefrom. The secured portion 2423 is configured to secure the connecting element 16 to the housing 30. The secured portion 2423 includes a protrusion 2424 and a semicircular annular member 2425 surrounding the protrusion 2424. The distance between the protrusion 2424 and the annular member 2425 is less than the thickness of the connecting element 16, thus the connecting element 16 can be tightly secured between the protrusion 2424 and the annular member 2425. Each inner wall 2422 has a trough 2426 defined therein. One trough 2426 accommodates the distal end of the first elastic member 124 of the first key 12, and another trough 2426 accommodates the distal end of the second elastic member 144 of the second key 14.

Figure 4:
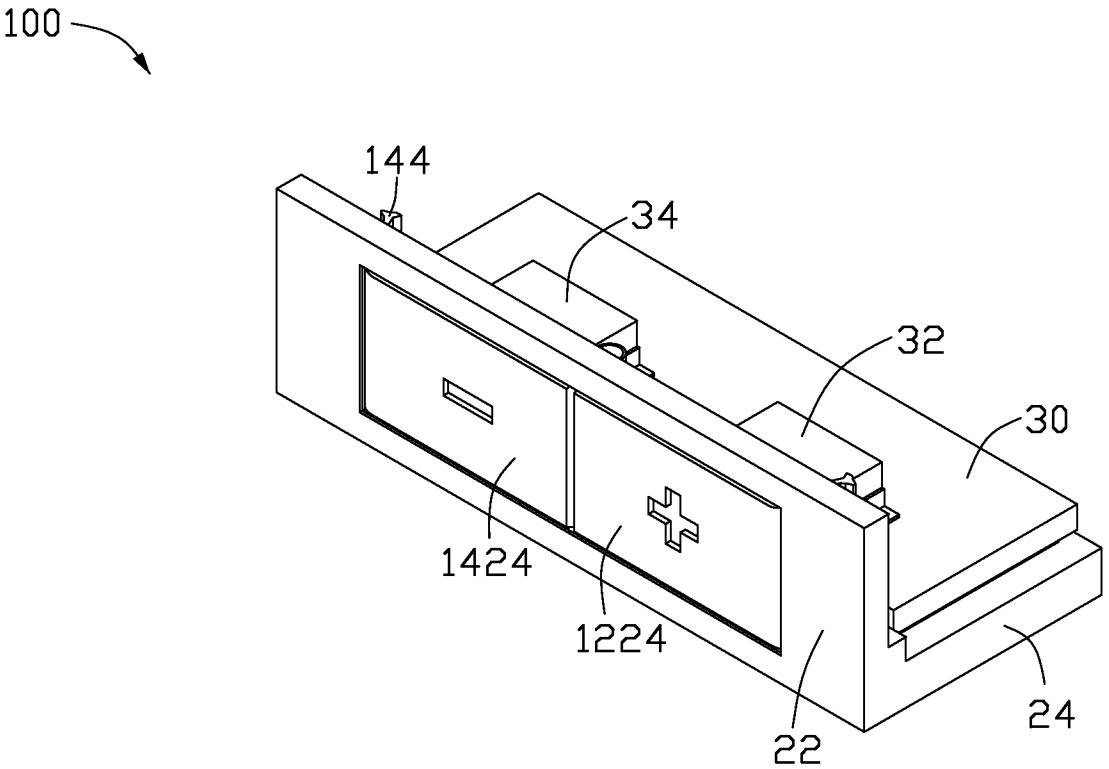
FIG. 4 is an assembled view of the portable electronic device shown in FIG 1.

Referring to FIGS. 4 and 5, during assembly of the portable electronic device, key assembly 10 is received in the hole 222, at this time, the connecting element 16 is secured with the secured portion 2423, the distal end of the first elastic member 124 and the distal end of the second elastic member 144 are secured in the troughs 2426, correspondingly. The circuit board 30 is attached to the bottom wall 24 with the first switch 32 resisting the first contact portion 1225 and the second switch 34 resisting the second contact portion 1425, that is, yielding to the portable electronic device.

Referring further to FIGS. 5 and 6, in which the first key 12 is depressed, and so action of only the first side key 12 is described herein but which equally applies to the second key 14 also. First, the first body member 122 is pressed along the direction of the arrow in FIG. 5, such that the first key 12 is moved toward the circuit board 30 to trigger the first switch 32. During this stage, portions of the connecting element 16 facing the first key 12 and portions of the first elastic member 124 where the first slot 1242 is defined, are deformed simultaneously to accumulate elastic force. Thus the first body member 122 can return to its original position by the accumulated elastic force.

The first key 12 and the second key 14 are spaced by the connecting element 16, such that only one key is depressed at a time.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A key assembly comprising:

a connecting element;

a first key comprising a first body member and a first elastic member protruding from one end of the first body member, another end of the first body member connecting with the connecting element; and a second key comprising a second body member and a second elastic member protruding from one end of the second body member, another end of the second body member connecting with the connecting element;

wherein the first elastic member comprises a first wedged plane defined at an outer side thereof, the first elastic member provides a returning force for the first body member, and the second elastic member provides a returning force for the second body member.

2. The key assembly of claim 1, wherein the connecting element is substantially a hollow cylinder comprising a slit longitudinally defined therein, in which two opposite sidewalls of the connecting element are defined, each sidewall comprising a connecting portion protruding therefrom and radially facing away from the center of the connecting element, one connecting portion configured to connect with the first key, and the other to connect with the second key.

3. The key assembly of claim 1, wherein the connecting element is injection-molded from thermoplastic elastomer.

4. The key assembly of claim 1, wherein the first elastic member comprises a first slot defined therein facilitating the deformed first elastic member.

5. The key assembly of claim 4, wherein the first slot is defined at a joint between the first body member and the first elastic member.

6. The key assembly of claim 1, wherein the second elastic member comprises a second slot defined therein for facilitating the deformed second elastic member.

7. The key assembly of claim 6, wherein the second slot is defined at a joint between the second body member and the second elastic member.

8. The key assembly of claim 1, wherein the second elastic member comprises a second wedged plane defined at an outer side thereof.

9. A portable electronic device, comprising:

a housing; and a side key assembly comprising:

a connecting element;

a first side key, the first side key including a first body member and a first elastic member protruding from one end of the first body member, another end of the first body member connecting with the connecting element; and a second side key, the second side key including a second body member and a second elastic member protruding from one end of the second body member, another end of the second body member connecting with the connecting element;

wherein the first elastic member has a first wedged plane defined at an outer side thereof, the first elastic member provides a force for first body member rebounded, the second elastic member provides a force for second body member rebounded.

10. The portable electronic device of claim 9, wherein the connecting element is substantially a hollow cylinder, the connecting element has a slit longitudinally defined therein, so two opposite sidewalls of the connecting element are defined in the slit, each sidewall has a connecting portion protruding therefrom and radially facing away from the center of the connecting element, one of the connecting portion is configured to connect with the first side key, another connecting portion is configured to connect with the second side key.

11. The portable electronic device of claim 10 wherein the housing includes a peripheral wall and a bottom wall connecting with the peripheral wall, the peripheral wall has a hole defined therein, the hole is sized and configured for engaging with the side key assembly.

12. The portable electronic device of claim 11, wherein the bottom wall has a groove defined therein adjacent to the peripheral wall, the groove communicates with the hole, so a footwall and two opposite inside walls are defined in the groove, the footwall has a securing portion protruding upwardly therefrom, the securing portion is configured to secure the connecting element to the housing.

13. The portable electronic device of claim 12, wherein the securing portion includes a protrusion and a semicircular annular member surrounding the protrusion, the distance between the protrusion and the annular member is smaller than the thickness of the connecting element, thus the connecting element is tightly secured between the protrusion and the annular member.

14. The portable electronic device of claim 12, wherein each inner wall has a trough defined therein, one of the trough accommodates the distal end of the first elastic member of the first side key, another trough accommodates the distal end of the second elastic member of the second side key.

15. The portable electronic device of claim 9, wherein the connecting element is constructed from injection-molded thermoplastic elastomer.

16. The portable electronic device of claim 9, wherein the first elastic member has a first slot defined therein for facilitating the first elastic distorted.

17. The portable electronic device of claim 16, wherein the first slot defined at a joint between the first body member and the first elastic member.

18. A portable electronic device, comprising:

a circuit board, the circuit board having a first switch and a second switch located apart from the first switch; and a side key assembly comprising:

a connecting element;

a first side key configured for triggering the first switch, the first side key including a first body member and a first elastic member protruding from one end of the first body member, another end of the first body member connecting with the connecting element; and a second side key configured for triggering the second switch, the second side key including a second body member and a second elastic member protruding from one end of the second body member, another end of the second body member connecting with the connecting element;

wherein the first elastic member has a first wedged plane defined at an outer side thereof, the first elastic member provides a force for first body member rebounded, the second elastic member provides a force for second body member rebounded.

* * * * *